US011632828B2

(12) United States Patent
Yuill et al.

(10) Patent No.: US 11,632,828 B2
(45) Date of Patent: Apr. 18, 2023

(54) COOKING APPLIANCE OPERABLE IN A CRISP REHEAT CYCLE

(71) Applicant: Haier US Appliance Solutions, Inc., Wilmington, DE (US)

(72) Inventors: Andrew James Yuill, Louisville, KY (US); Judy Carol Hite, Louisville, KY (US); Sabrina Marie Hannah, Louisville, KY (US); Karen Marie Edberg, Louisville, KY (US); Brigid Lally Blocker, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 549 days.

(21) Appl. No.: 16/538,925

(22) Filed: Aug. 13, 2019

(65) Prior Publication Data

US 2021/0051773 A1 Feb. 18, 2021

(51) Int. Cl.
*H05B 6/64* (2006.01)
*H05B 6/78* (2006.01)

(52) U.S. Cl.
CPC ..... *H05B 6/6435* (2013.01); *H05B 6/6473* (2013.01); *H05B 6/6485* (2013.01); *H05B 6/78* (2013.01)

(58) Field of Classification Search
CPC .. H05B 6/6435; H05B 6/6473; H05B 6/6485; H05B 6/68; H05B 6/78
USPC ..... 219/680, 681, 682, 685, 687, 690, 678, 219/702, 703, 704, 705, 717, 725, 729, 219/730, 746, 748, 751, 749, 761, 506, 219/494, 497, 714, 719; 126/21 A
See application file for complete search history.

(56) References Cited

U.S. PATENT DOCUMENTS 5,321,232 A * 6/1994 Ogle ..... F24C 7/087 219/719
5,426,280 A * 6/1995 Smith ..... H05B 6/6441 219/506
6,355,914 B1 3/2002 Stockley
6,815,644 B1 * 11/2004 Muegge ..... F24C 15/325 219/396
6,987,252 B2 1/2006 Graves et al.
7,683,292 B2 3/2010 Cavada et al.
8,136,442 B2 3/2012 Strutin-Belinoff et al.
(Continued)

FOREIGN PATENT DOCUMENTS

WO WO2018004539 A1 1/2018

*Primary Examiner* — Quang T Van
(74) *Attorney, Agent, or Firm* — Dority & Manning, P.A.

(57) ABSTRACT

A cooking appliance and methods for operating the same in a crisp reheat cycle are provided. In one example aspect, the cooking appliance includes features for crisp reheating a food item that has been cooked and chilled thereafter. The cooking appliance includes a casing defining a cooking cavity configured to receive food items. The cooking appliance also includes a controller. The controller can access data that provides a plurality of crisp reheating instructions for operating the cooking appliance in a crisp reheat cycle for various food items. The controller retrieves a crisp reheating instruction associated with a food type selected by a user. The controller then commences the crisp reheat cycle by activating heating elements of the cooking appliance, such as a microwave module, an upper heater module, a lower heater module, and a convection module.

18 Claims, 8 Drawing Sheets

(56) References Cited

U.S. PATENT DOCUMENTS

| | | | | |
|---|---|---|---|---|
| 9,433,233 | B2 | 9/2016 | Lim et al. | |
| 2003/0024925 | A1* | 2/2003 | Graves | H05B 6/6473 219/681 |
| 2005/0226962 | A1 | 10/2005 | Howard et al. | |
| 2011/0297672 | A1* | 12/2011 | Niklasson | H05B 6/6402 219/702 |

* cited by examiner

170

| FOOD ITEM TYPE | CLASSIFICATION | AMOUNT | COOK TIME | CYCLE TIME | | | | POWER LEVEL | | | | TURN TIME | CHECK FOR DONENESS |
|---|---|---|---|---|---|---|---|---|---|---|---|---|---|
| | | | | U | L | M | C | U | L | M | C | | |
| ROLLS/BREAD | | 1-2 PIECES | 5:00 | 32 | 26 | 0 | 0 | 10 | 8 | 0 | 0 | N/A | 1:00 |
| | | 3-4 PIECES | 5:00 | 32 | 26 | 0 | 0 | 10 | 8 | 0 | 0 | N/A | 1:00 |
| CASSEROLE | | 1-2 SERVINGS | 7:00 | 32 | 32 | 8 | 32 | 10 | 10 | 2 | 10 | N/A | 1:30 |
| | | 3-4 SERVINGS | 10:00 | 23 | 29 | 11 | 32 | 7 | 9 | 3 | 10 | N/A | 1:30 |
| CHICKEN | BREAST | 1-2 PIECES | 11:00 | 32 | 26 | 11 | 0 | 10 | 8 | 3 | 0 | 3:00 | 7:00 |
| | BREAST | 3-4 PIECES | 11:00 | 32 | 26 | 11 | 0 | 10 | 8 | 3 | 0 | 3:00 | 7:00 |
| | NUGGETS | 1-2 CUPS | 7:00 | 32 | 32 | 0 | 32 | 10 | 10 | 0 | 10 | N/A | 3:00 |
| | NUGGETS | 3-4 CUPS | 8:00 | 32 | 32 | 0 | 32 | 10 | 10 | 0 | 10 | N/A | 2:00 |
| | TENDERS | 1-2 PIECES | 9:00 | 32 | 32 | 0 | 32 | 10 | 10 | 0 | 10 | 6:00 | 3:00 |
| | TENDERS | 3-4 PIECES | 9:00 | 32 | 32 | 0 | 32 | 10 | 10 | 0 | 10 | 6:00 | 3:00 |
| | WINGS | 1-2 PIECES | 7:30 | 32 | 32 | 8 | 0 | 10 | 10 | 2 | 0 | 4:00 | 2:00 |
| | WINGS | 3-4 PIECES | 7:30 | 32 | 32 | 8 | 0 | 10 | 10 | 2 | 0 | 4:00 | 2:00 |
| PIZZA | | 1-2 SLICES | 6:30 | 32 | 32 | 5 | 32 | 10 | 10 | 1 | 10 | N/A | 2:30 |
| | | 3-4 SLICES | 6:30 | 32 | 32 | 5 | 32 | 10 | 10 | 1 | 10 | N/A | 2:30 |
| POTATOES | BAKED | 1/2-2 PIECES | 6:00 | 32 | 32 | 20 | 32 | 10 | 10 | 6 | 10 | N/A | 1:30 |
| | BAKED | 3-4 PIECES | 6:30 | 32 | 32 | 20 | 32 | 10 | 10 | 6 | 10 | N/A | 1:00 |
| | ROASTED | 1-2 CUPS | 7:00 | 32 | 32 | 0 | 32 | 10 | 10 | 0 | 10 | N/A | 2:00 |
| | ROASTED | 3-4 CUPS | 7:00 | 32 | 32 | 0 | 32 | 10 | 10 | 0 | 10 | N/A | 2:00 |
| | SKINS | 1-2 PIECES | 8:00 | 32 | 32 | 0 | 32 | 10 | 10 | 0 | 10 | N/A | 2:00 |
| | SKINS | 3-4 PIECES | 8:00 | 32 | 32 | 0 | 32 | 10 | 10 | 0 | 10 | N/A | 2:00 |
| | FRIES/TOTS | 1-2 CUPS | 7:00 | 32 | 32 | 0 | 32 | 10 | 10 | 0 | 10 | N/A | 3:00 |
| | FRIES/TOTS | 3-4 CUPS | 8:00 | 32 | 32 | 0 | 32 | 10 | 10 | 0 | 10 | N/A | 2:00 |

FIG. 13A

| | | | | CYCLE TIME | | | | POWER LEVEL | | | | | |
|---|---|---|---|---|---|---|---|---|---|---|---|---|---|
| FOOD ITEM | SUBCATEGORY | AMOUNT | COOK TIME | U | L | M | C | U | L | M | C | TURN TIME | CHECK FOR DONENESS |
| FRIED FINGER FOOD | | 1-2 CUPS | 7:00 | 32 | 32 | 0 | 32 | 10 | 10 | 0 | 10 | N/A | 3:00 |
| | | 3-4 CUPS | 7:00 | 32 | 32 | 0 | 32 | 10 | 10 | 0 | 10 | N/A | 2:00 |
| PANCAKE/WAFFLE | | 1-2 PIECES | 4:30 | 32 | 32 | 5 | 17 | 10 | 10 | 1 | 5 | 3:30 | 2:30 |
| | | 3-4 PIECES | 4:30 | 32 | 32 | 5 | 17 | 10 | 10 | 1 | 5 | 3:30 | 2:30 |
| PIE | SAVORY | 1-2 SLICES | 8:30 | 32 | 32 | 8 | 32 | 10 | 10 | 2 | 10 | N/A | 3:45 |
| | SAVORY | 3-4 SLICES | 9:30 | 29 | 29 | 11 | 32 | 9 | 9 | 3 | 10 | N/A | 4:45 |
| | SWEET | 1-2 SLICES | 5:30 | 32 | 32 | 5 | 32 | 10 | 10 | 1 | 10 | N/A | 1:30 |
| | SWEET | 3-4 SLICES | 5:30 | 32 | 32 | 5 | 32 | 10 | 10 | 1 | 10 | N/A | 1:30 |
| QUICHE | | 1-2 SLICES | 6:00 | 32 | 32 | 8 | 32 | 10 | 10 | 2 | 10 | N/A | 2:00 |
| | | 3-4 SLICES | 6:00 | 32 | 32 | 8 | 32 | 10 | 10 | 2 | 10 | N/A | 2:00 |

FIG. 13B

COOKING APPLIANCE OPERABLE IN A CRISP REHEAT CYCLE

FIELD OF THE INVENTION

The subject matter of the present disclosure relates generally to cooking appliances, and more particularly to cooking appliances operable in a crisp reheat cycle.

BACKGROUND OF THE INVENTION

Crispy food items (e.g., pizza, fried chicken, french fries, etc.) tend to lose their crisp when they are stored in a refrigerator appliance or other chilled chamber. One conventional method to return crisp to a food item previously stored in a chilled chamber includes reheating the crispy food item in a cooking appliance, such as a convection oven. This method can be very time consuming, especially if a long preheat time is required for the cooking appliance to reach the set point temperature. A faster method for attempting to return crisp to a food item previously stored in a chilled chamber includes reheating the food item using a microwave appliance. However, such methods typically fail to return the original crispiness back to the food item and often results in soggy food.

Accordingly, a cooking appliance and method for operating the same that address one or more of the challenges noted above would be desirable.

BRIEF DESCRIPTION OF THE INVENTION

Aspects and advantages of the invention will be set forth in part in the following description, or may be apparent from the description, or may be learned through practice of the invention.

In one exemplary embodiment, a cooking appliance is provided. The cooking appliance includes a casing defining a cooking cavity. The cooking appliance also includes a microwave module for delivering microwave energy into the cooking cavity. The cooking appliance further includes an upper heater module having one or more heating elements. The cooking appliance also includes a lower heater module having one or more heating elements. In addition, the cooking appliance includes a convection module having one or more heating elements and a convection fan operable to move air within the cooking cavity. The cooking appliance also includes a controller communicatively coupled with the microwave module, the upper heater module, the lower heater module, and the convection module for selective control thereof. The controller is configured to: receive an input indicating that the cooking appliance is to operate in a crisp reheat cycle; receive an input indicating a food type of a food item to be crisp heated within the cooking cavity of the cooking appliance in the crisp reheat cycle; access data that provides a plurality of crisp reheat instructions that each provide instructions for operating the cooking appliance in the crisp reheat cycle for an associated food type; retrieve a crisp reheat instruction from the plurality of crisp reheat instructions provided by the data based at least in part on the input indicating the food type of the food item to be crisp reheated within the cooking cavity of the cooking appliance in the crisp reheat cycle; and activate at least one of the microwave module, the upper heater module, the lower heater module, and the convection module of the cooking appliance to crisp reheat the food item in the crisp reheat cycle based at least in part on the retrieved crisp reheat instruction.

In another exemplary embodiment, a method for operating a cooking appliance in a crisp reheat cycle is provided. The method includes receiving, by a controller of the cooking appliance, an input indicating that the cooking appliance is to operate in the crisp reheat cycle. The method also includes receiving, by the controller of the cooking appliance, an input indicating a food type of a food item to be crisp reheated within a cooking cavity of the cooking appliance in the crisp reheat cycle. Further, the method includes accessing, by the controller, data that provides a plurality of crisp reheat instructions that each provide instructions for operating the cooking appliance in the crisp reheat cycle for an associated food type. The method also includes retrieving, by the controller, a crisp reheat instruction from the plurality of crisp reheat instructions provided by the data based at least in part on the input indicating the food type of the food item to be crisp reheated within the cooking cavity of the cooking appliance in the crisp reheat cycle. In addition, the method includes activating, by the controller, at least two of a microwave module, an upper heater module, a lower heater module, and a convection module of the cooking appliance to crisp reheat the food item in the crisp reheat cycle based at least in part on the retrieved crisp reheat instruction.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which:

FIGS. 13A and 13B provide a menu tree indicating instructions for operating the cooking appliance of FIG. 1 in accordance with the selected settings.

DETAILED DESCRIPTION

Figure 1:
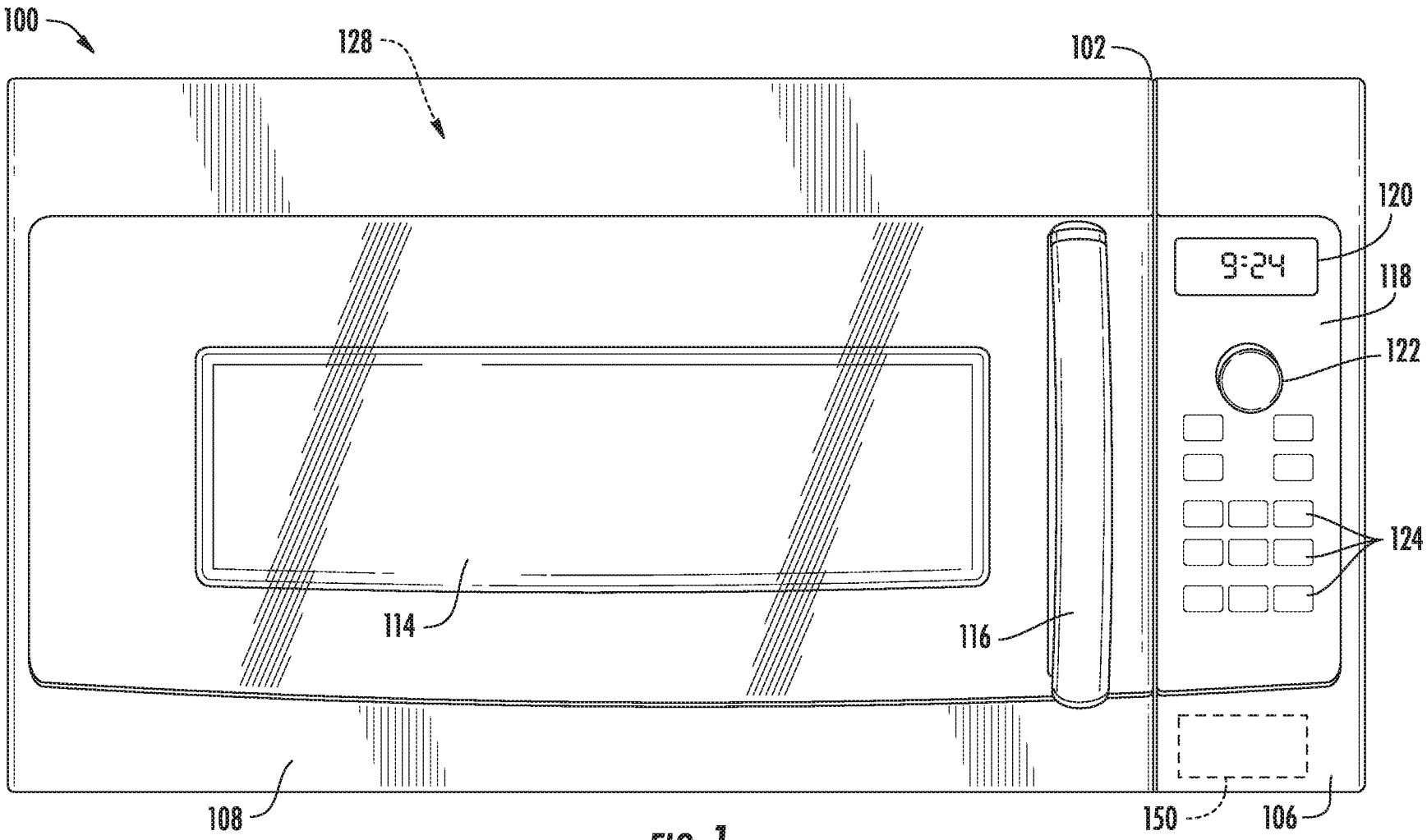
FIG. 1 provides a front view of a cooking appliance according to an example embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents. As used herein, terms of approximation, such as "approximately," "substantially," or "about," refer to being within a ten percent (10%) margin of error of the stated value. Moreover, as used herein, the terms "first", "second", and "third" may be used interchangeably to distinguish one component from another and are not intended to signify location or importance of the individual components.

FIG. 1 provides a front view of a cooking appliance 100 according to an example embodiment of the present subject matter. Cooking appliance 100 can be the oven illustrated and described in U.S. Pat. No. 6,987,252 issued Jan. 17, 2006, which is hereby incorporated by reference in its entirety. Although cooking appliance 100 is shown as an "over-the-range" oven in the illustrated embodiment of FIG. 1, it will be appreciated that the inventive aspects of the subject matter of the present disclosure can apply to other suitable cooking appliances equipped with the crisp reheat features described herein.

Cooking appliance 100 includes a housing or casing 102 that defines a cooking cavity 128. Food items can be received within cooking cavity 128. A door 108 is rotatably mounted to casing 102 and is movable between an open position and a closed position (shown in FIG. 1) to provide selective access to cooking cavity 128. A window 114 in door 108 is provided for viewing food items in the cooking cavity 128, and a handle 116 is secured to door 108. Handle 116 can be formed of plastic, for example, and can be injection molded. Cooking appliance 100 also includes a control panel frame 106. A control panel 118 is mounted within control panel frame 106.

Control panel 118 includes a display device 120 for presenting various information to a user. Control panel 118 also includes one or more input devices. For this embodiment, the input devices of control panel 118 include a knob or dial 122 and tactile control buttons 124. Selections are made by rotating dial 122 clockwise or counter-clockwise, and when the desired selection is displayed, pressing dial 122. For example, many crisp reheat and other cooking algorithms can be preprogrammed in or loaded onto a memory device of a controller 150 of cooking appliance 100 for many different food items types (e.g., pizza, fried chicken, french fries, potatoes, etc.). When a user is cooking a particular food item for which there is a preprogrammed cooking algorithm, the preprogrammed cooking algorithm can be selected by rotating dial 122 until the selected food name is displayed and then pressing dial 122. Instructions and selections are displayed on display device 120. Furthermore, in some embodiments, display device 120 can also be used as an input device. For instance, in such embodiments, display device 120 can be a touchscreen device. In some embodiments, display device 120 is the only input device of control panel 118.

The following functions can be selected from respective control buttons 124 of control panel 118. One of the control buttons 124 can be labeled "PRECISION COOKING". The "PRECISION COOKING" control button can enable a user to perform the following precision cooking functions: 1) manually enter precision cooking time and power levels, 2) select preprogrammed control algorithms, or 3) store manually programmed algorithms as recipes. Moreover, as will be explained in detail herein, selection of the "PRECISION COOKING" control button can provide access to a "CRISP REHEAT" cycle that provides dedicated functionality for reheating crispy food items. "CRISP REHEAT" functions can enable a user to perform various crisp reheat functions, including selecting preprogrammed crisp reheat control algorithms. In some embodiments, control panel 118 can include a dedicated control button labeled as "CRISP REHEAT" that enables crisp reheat functionality.

Figure 2:
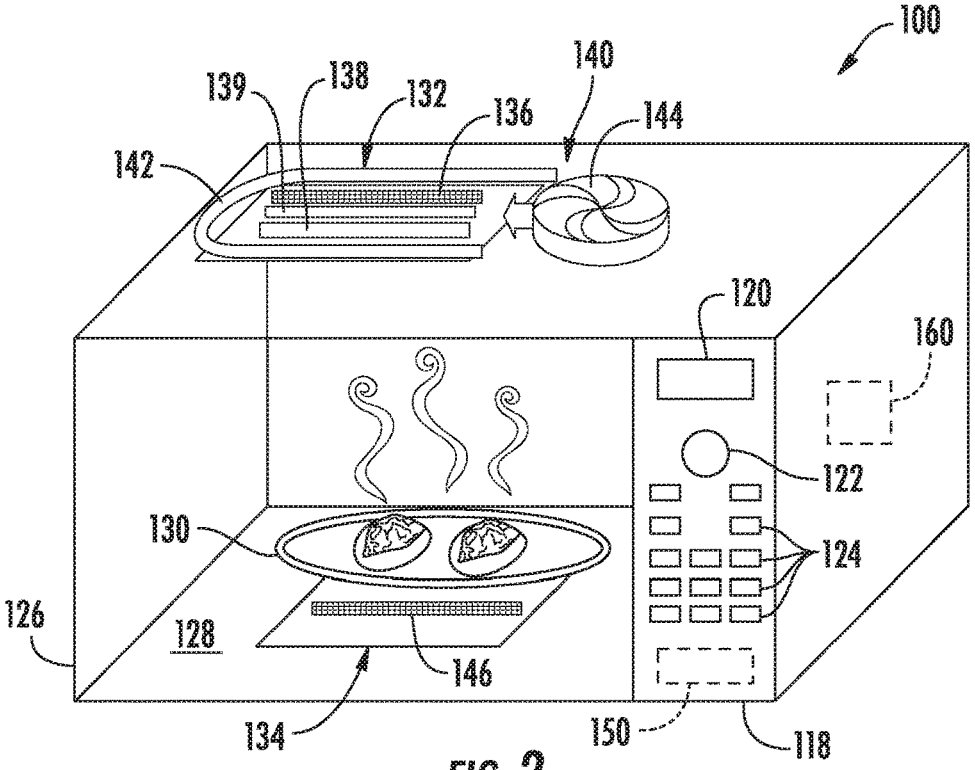
FIG. 2 provides a schematic view of the cooking appliance of FIG. 1.

FIG. 2 provides a schematic view of cooking appliance 100. As shown in FIG. 2, for this example embodiment, casing 102 (FIG. 1) of cooking appliance 100 includes a shell 126. Shell 126 of casing 102 delineates the interior volume of cooking cavity 128. The walls of shell 126 are constructed using high reflectivity (e.g., 72% reflectivity) stainless steel. A turntable 130 is located in cooking cavity 128 and is rotatable about an axis of rotation, e.g., for rotating food items during a cooking operation.

Further, cooking appliance 100 includes a microwave module 160, an upper heater module 132, a lower heater module 134, and a convection module 140. Microwave module 160 includes a magnetron located on a side of cooking cavity 128. In some embodiments, the magnetron of microwave module 160 delivers microwave energy into cooking cavity 128. Upper heater module 132 can include one or more heating elements. For instance, upper heating module 132 can include one or more halogen cooking lamps and/or one or more ceramic heaters. For the depicted embodiment of FIG. 2, upper heating module 132 includes a ceramic heater 136 and a halogen cooking lamp 138. In some example embodiments, to facilitate extra crispiness of cooked food items, upper heater module 132 has at least two halogen lamps 138, 139 configured to deliver radiant and thermal energy into the cooking cavity 128.

Convection module 140 includes a sheath heater 142 and a convection fan 144. Convection fan 144 is provided for blowing or otherwise moving air over sheath heater 142 of convection module 140 and into cooking cavity 128, e.g., for convection cooking. Lower heater module 134 includes at least one heating element. The heating element of lower heater module 134 can be a ceramic heater or a halogen lamp, for example. For the depicted embodiment of FIG. 2, the heating element of lower heater module 134 is illustrated as a ceramic heater 146. Cooking appliance 100 can be a 240V cooking appliance or a 120V cooking appliance, for example.

The specific heating elements of upper and lower heater modules 132, 134, convection module 140, and radio frequency (RF) generation system of microwave module 160 (e.g., a magnetron) can vary from embodiment to embodiment, and the elements and system described above are exemplary only. For example, the upper heater module 132 can include any combination of heaters including combinations of halogen lamps, ceramic lamps, and/or sheath heaters. Similarly, lower heater module 134 can include any combination of heaters including combinations of halogen lamps, ceramic lamps, and/or sheath heaters. In addition, the heaters can all be one type of heater. The specific ratings and number of lamps and/or heaters utilized in the upper and lower modules 132, 134 and convection module 140 can vary from embodiment to embodiment. Generally, the combinations of lamps, heaters, and RF generation system is selected to provide the desired cooking characteristics for precision cooking, which includes crisp reheating, microwave, and convection/bake modes.

Returning to FIG. 1, cooking appliance 100 includes controller 150. Controller 150 of cooking appliance 100 can include one or more processor(s) and one or more memory device(s). The processor(s) of controller 150 can be any suitable processing device, such as a microprocessor, microcontroller, integrated circuit, or other suitable processing device. The memory device(s) of controller 150 can include any suitable computing system or media, including, but not limited to, non-transitory computer-readable media, RAM, ROM, hard drives, flash drives, or other memory devices. The memory device(s) of controller 150 can store information accessible by the processor(s) of controller 150 including instructions that can be executed by the processor(s) of controller 150 in order to execute various cooking operations or cycles, e.g., a crisp reheat cycle. Controller 150 is communicatively coupled with various operational components of cooking appliance 100, such as components of microwave module 160, upper heater module 132, lower heater module 134, convection module 140, and control panel 118, including display device 120, dial 122, the various control buttons 124, etc. Input/output ("I/O") signals may be routed between controller 150 and control panel 118 as well as other operational components of cooking appliance 100. Controller 150 can execute and control cooking appliance 100 in various cooking operations or cycles, such as precision cooking, which includes crisp reheating, microwave, and convection/bake modes.

Figure 3:
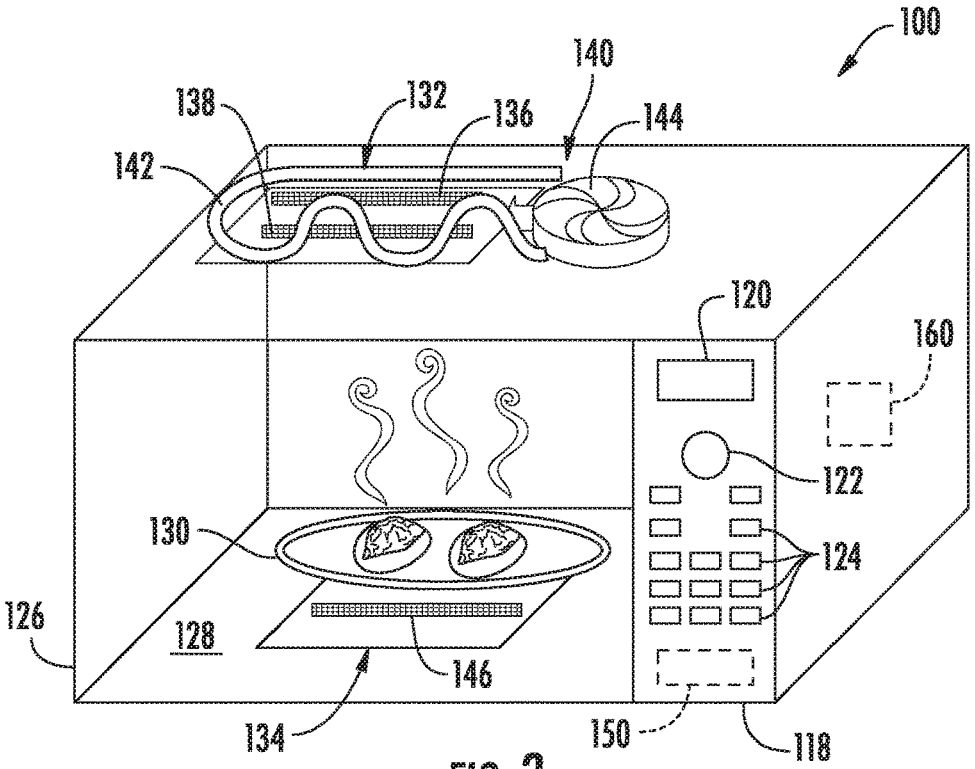
FIG. 3 provides a schematic view of the cooking appliance of FIG. 1 in a convection/bake mode.
Figure 4:
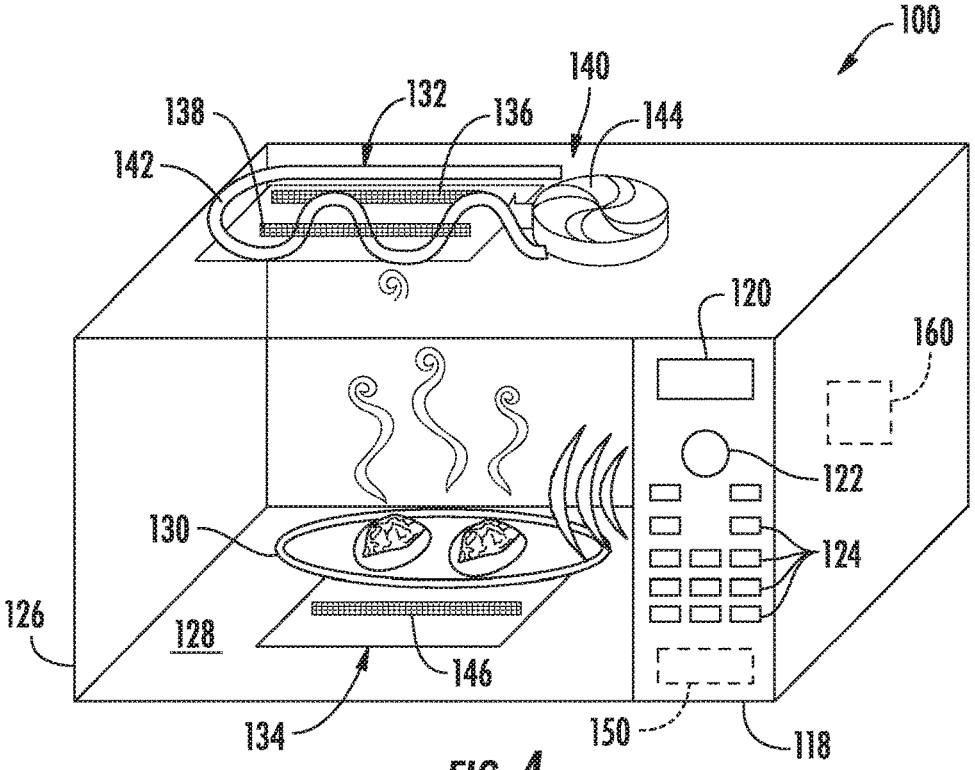
FIG. 4 provides a schematic view of the cooking appliance of FIG. 1 in a microwave only mode.
Figure 5:
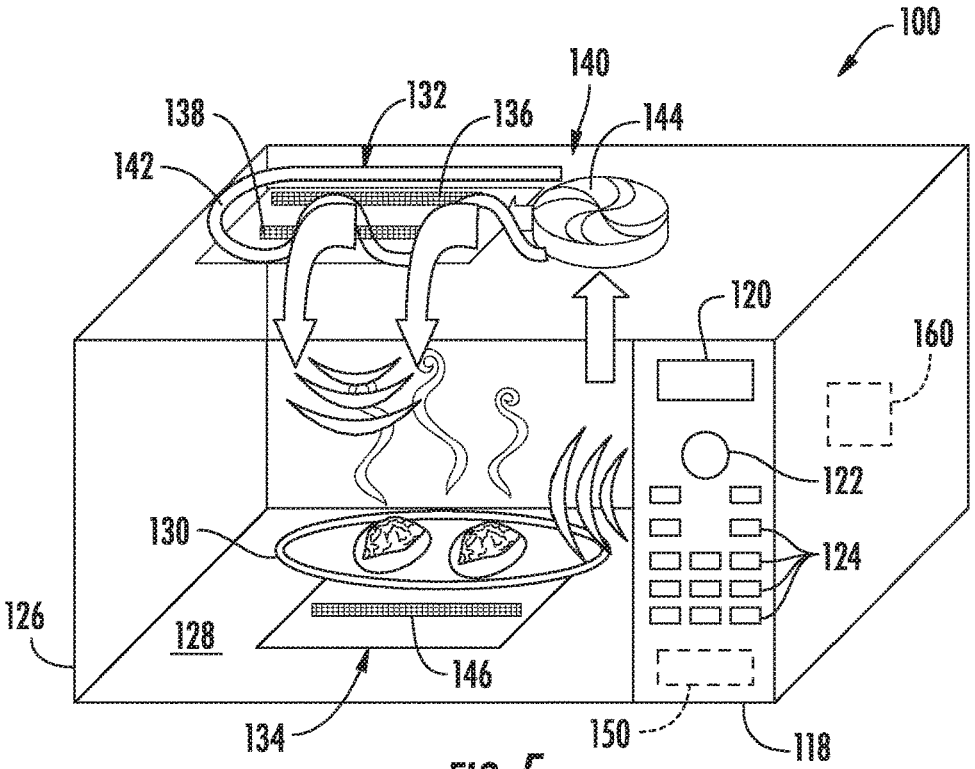
FIG. 5 provides a schematic view of the cooking appliance of FIG. 1 in a crisp reheat mode.

FIGS. 3, 4, and 5 schematically illustrate operation of cooking appliance 100 in various modes. Cooking appliance 100 can operate in fewer or more modes or cycles than as illustrated in FIGS. 3, 4, and 5, and the descriptions set forth below are exemplary only. In addition, operation and use of cooking appliance 100 is not limited to the specific order of steps described below. Various steps can be performed in orders different from the exemplary order described below.

FIG. 3 provides a schematic view of cooking appliance 100 operating in a convection/bake mode. Generally, for the convection/bake mode, a user selects "Convection/Bake" from control panel 118, and then uses dial 122 to select a temperature and cook time. Lower ceramic heater 146 and sheath heater 142 are then energized to preheat the air in cooking cavity 128. The food is then placed in cooking cavity 128 and cooking begins. During the cooking cycle, convection fan 144 circulates air to assure even cooking. Controller 150 can activate convection fan 144 (e.g., via one or more command signals) such that convection fan 144 moves air over sheath heater 142, and in some embodiments heating elements of upper heater module 132. In this way, heated air is moved into cooking cavity 128, e.g., for convection cooking.

FIG. 4 provides a schematic view of cooking appliance 100 operating in a microwave mode, sometimes referred to herein as a microwave only mode. Generally, for the microwave mode, the user places food in cooking cavity 128 on turntable 130. The user then selects "Microwave" or "Express" from control panel 118. Dial 122 can utilized to select a food type, and once the food type is selected, the user selects "Start" from control panel 118. The magnetron of microwave module 160 is then energized in accordance with the user selections. In some embodiments, the user can select the desired cook time and power level and then may select "START" to commence the microwave only cooking operation.

FIGS. 5 through 13B provide an example manner in which cooking appliance 100 can cook food items in a crisp reheat cycle. FIG. 5 provides a schematic view of cooking appliance 100 operating in a precision cooking mode, and more particularly, a crisp reheat cycle or mode of the precision cooking mode. FIGS. 6 through 12 provide various views of display device 120 of cooking appliance 100 depicting a progression for selecting settings of a crisp reheat cycle. Moreover, FIGS. 13A and 13B provide a menu tree indicative of instructions for operating cooking appliance 100 in a crisp reheat cycle in accordance with the selected settings. Generally, in the crisp reheat mode, cooking appliance 100 can use one or a combination of microwave module 160, upper/lower heater modules 132, 134, convection module 140, and convection technology to reheat refrigerated leftover food items with a crisp exterior. Particularly, the crisp reheat cycle is for reheating food items that have been previously heated and then cooled, e.g., in a chilled chamber of a refrigerator appliance. In this way, leftover food items can be reheated and the crispy exterior of the food item can be restored or enhanced.

Figure 6:
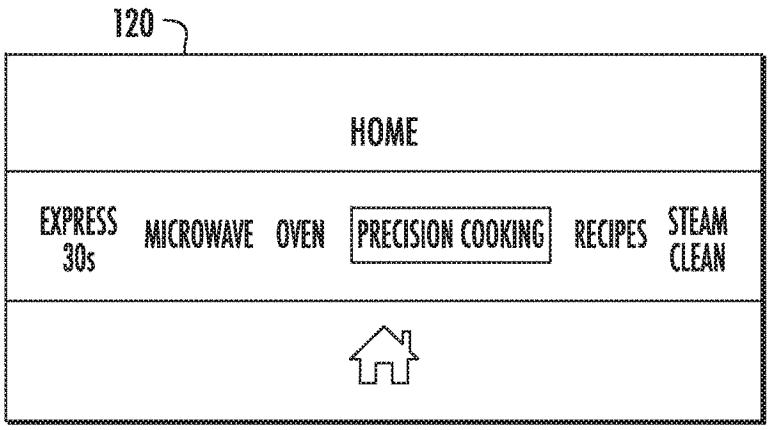
FIGS. 6 through 12 provide various views of a display device of the cooking appliance of FIG. 1 depicting a progression for selecting settings of a crisp reheat cycle.
Figure 7:
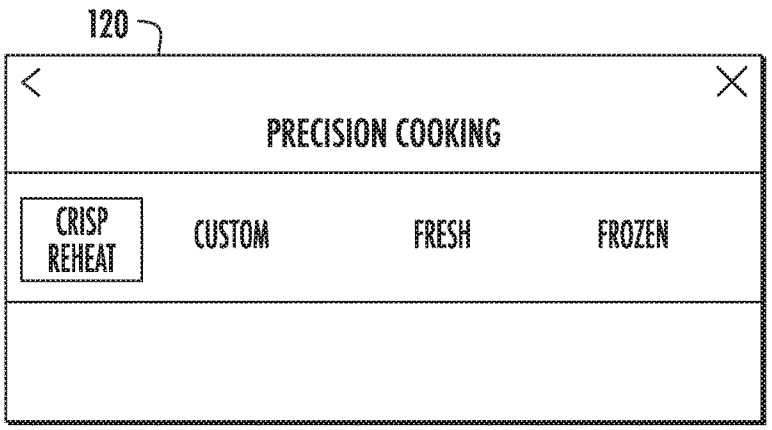

Referring generally to FIG. 5 and to specific figures referenced throughout, a user can commence a crisp reheat cycle in a number of suitable ways. For instance, a user can place food items in cooking cavity 128 on turntable 130 and can commence a crisp reheat cycle by providing a user input to select the "PRECISION COOKING" option on the home page of display device 120 as shown in FIG. 6. For example, display device 120 can be a touchscreen device and a user can provide a touch input to the "PRECISION COOKING" icon. Then, as shown in FIG. 7, a user can provide a user input to select the "CRISP REHEAT" option on a subsequent screen of display device 120. Alternatively, a user can provide a user input to select the dedicated "PRECISION COOKING" control button 124 depicted in FIG. 1 and can then provide a user input to select the "CRISP REHEAT" option as shown in FIG. 7. In yet other embodiments, a user can provide a user input to select "CRISP REHEAT" from control panel 118 in embodiments in which "CRISP REHEAT" is a dedicated control button 124. In yet other embodiments, a user can commence a crisp reheat cycle via user input in other suitable ways. Controller 150 can receive an input indicating that cooking appliance 100 is to operate in a crisp reheat mode or cycle. That is, based on one or more user inputs (e.g., a touch input to the "PRECISION COOKING" icon and then a subsequent touch input to the "CRISP REHEAT" icon), controller 150 can receive an input indicating that cooking appliance 100 is to operate in a crisp reheat mode or cycle.

Figure 8:
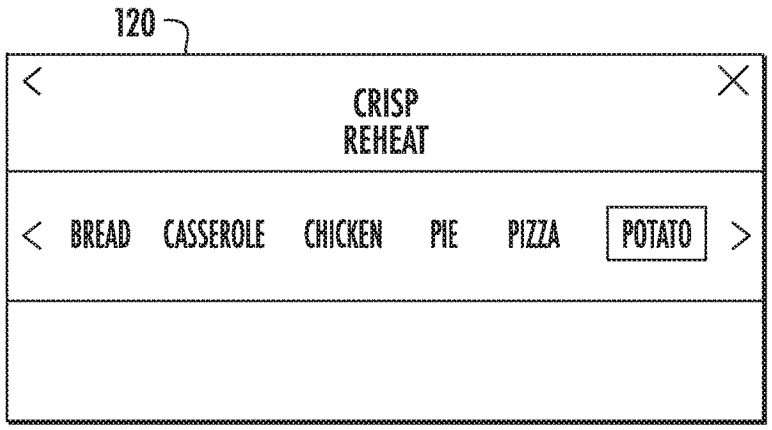

Once the crisp reheat mode is selected (e.g., by selection of the "CRISP REHEAT" option), a user can select a food type of the food item to be cooked in the crisp reheat mode within cooking cavity 128 of cooking appliance 100. For instance, a user can provide a user input to select a food type of the food item to be cooked in the crisp reheat mode as shown in FIG. 8. In FIG. 8, a user has provided a touch input to select "POTATO" as the food type from among a plurality of food types. In yet other embodiments, a user can use dial 122 in combination with display device 120 to select the food type. For example, once the crisp reheat mode is selected, various food items can be displayed by display device 120. Dial 122 can be used to scroll through the displayed food items and a user can select a food type by pressing dial 122 inward or by selecting some other confirmation control button 124. Controller 150 can receive an input indicating a food type of the food item to be cooked in the crisp reheat mode within cooking cavity 128 of cooking appliance 100.

Figure 9:
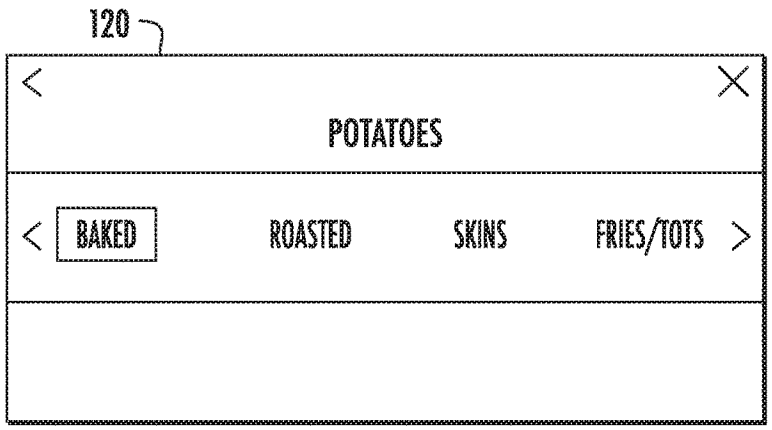

Once a user has selected the food type of the food item to be cooked in the crisp reheat mode, in some embodiments, a user can classify the selected food type, e.g., into a class or subcategory of the food type. For instance, as shown in FIG. 9, once "POTATO" is selected as the food type (as shown in FIG. 8), a user can select "BAKED", "ROASTED", "SKINS", "FRIES/TOTS", etc. to classify the food type. In this example, the user has provided a touch input to classify "POTATO" as "BAKED" Controller 150 can receive an input indicating a food item classification of the food type. For instance, in the example above, controller 150 can receive an input indicating that the food type "POTATO" has been classified as "BAKED".

Figure 10:
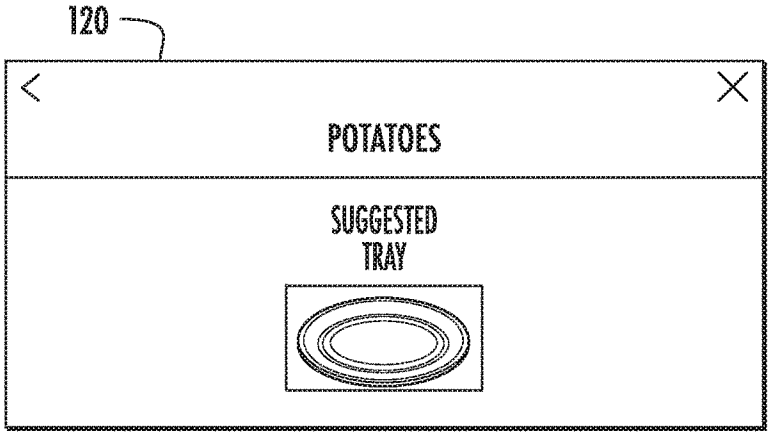

Further, in some embodiments, once a user has selected the food type of the food item to be cooked in the crisp reheat mode, a user can select a food item amount of the food item to be cooked in the crisp reheat mode within cooking cavity 128 of cooking appliance 100. For instance, a user can provide a user input to select a food item amount of the food item to be cooked in the crisp reheat mode as shown in FIG. 10. In FIG. 10, a user is provided the option of selecting "2 OR LESS" or "3 OR MORE" potatoes. As depicted, the user has provided a touch input to select "2 OR LESS" as the food item amount from among the amount options. As will be appreciated, more or less food item amount options can be made available or presented to a user. In yet other embodiments, a user can use dial 122 (FIG. 1) in combination with display device 120 to select the food item amount. For example, once the crisp reheat cycle is selected, various food item amounts associated with the selected food item can be displayed by display device 120. Dial 122 can be used to scroll through the displayed food item amounts and a user can select a food item amount by pressing dial 122 inward or by selecting some other confirmation control button 124. Controller 150 can receive an input indicating a food item amount of the food item to be cooked in the crisp reheat mode within cooking cavity 128 of cooking appliance 100.

Figure 11:
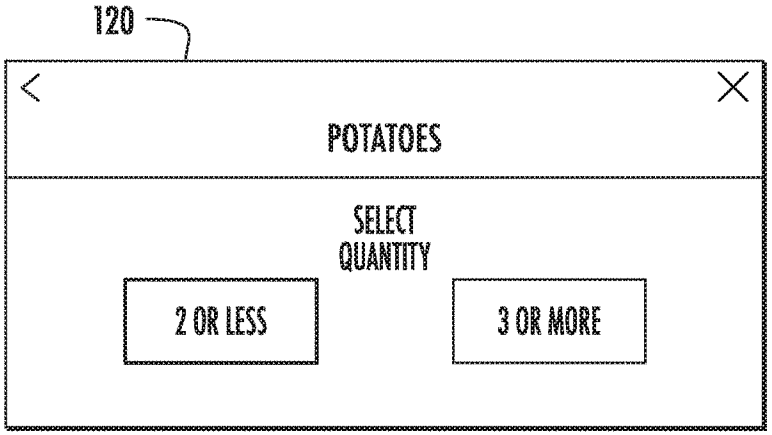

In some embodiments, once a user has selected the food type of the food item to be crisp reheated in the crisp reheat cycle, controller 150 can cause display device 120 to present or display a suggested cooking utensil for cooking the selected food items in the crisp reheat cycle as shown in FIG. 11. Controller 150 can cause display device 120 to present the suggested cooking utensil based at least in part on the selected food type (e.g., POTATO), and/or the classification of the food type (e.g., BAKED), and/or the selected food item amount (e.g., "2 OR LESS"). In some embodiments, for example, the cooking utensil suggested by controller 150 can be suggested based at least in part on the food item selected, the food item amount, and the food item classification. Further, in some embodiments, the cooking utensil shape, cooking utensil size, and/or cooking utensil material (e.g., metal or glass) of the suggested cooking utensil can be presented to a user via display device 120.

Once a user has provided one or more user inputs to select the food type, the food item classification, the food item amount, and the suggested cooking utensil is presented to the user via display device 120, controller 150 is configured to access data that provides a plurality of crisp reheat instructions. That is, controller 150 can access data that provides crisp reheat instructions for crisp reheating various food items. Each of the plurality of crisp reheat instructions provide instructions for operating cooking appliance 100 in the crisp reheat cycle for a given or associated food type. The crisp reheat instructions provided by the data set can not only provide instructions for operating cooking appliance 100 in the crisp reheat cycle for an associated food type, but also for an associated food item amount, and food item classification. As will be explained further herein, by accessing the data, controller 150 can retrieve crisp reheat instructions associated with the selected food type, food item classification, and food item amount. Controller 150 can then execute the retrieved crisp reheat instructions to crisp reheat the food item.

For instance, as shown in FIGS. 13A and 13B, data 170 in the form of an example menu tree is provided. As shown, the menu tree of the data 170 includes a plurality of crisp reheat instructions (organized by row in FIGS. 13A and 13B) for operating cooking appliance 100 in the crisp reheat cycle for a given or associated food type. Particularly, for each food type, and in some instances, the classification of the food type and the food item amount, each of the crisp reheat instructions includes a cook time, a cycle time for each of the heating modules 132, 134, 160, 140 based on a thirty-two second (32 s) duty cycle, and a power level on a zero to ten scale (0-10) for each of the heating modules 132, 134, 160, 140. The cycle times for the heating modules 132, 134, 160, 140 represent the number of seconds during the thirty-two second (32 s) duty cycle in which the heating modules 132, 134, 160, 140 are to be activated to generate heat or move air through cooking cavity 128. In the menu tree shown in FIGS. 13A and 13B, the columns "U", "L", "M", and "C" correspond with the upper heater module 132, the lower heater module 134, the microwave module 160, and the convection module 140, respectively.

The various heating modules 132, 134, 160, 140 can be further broken down into sub columns based on the individual heating elements that make up the heating module. For instance, upper heater module 132 can be broken down into ceramic heater 136, halogen lamp 138. That is, ceramic heater 136 can have a column associated with cycle time and a column associated with power level and halogen lamp 138 can have a column associated with cycle time and a column associated with power level. In this way, different heating elements of a particular module can be activated at different power levels and cycle times than one another. As will be appreciated, the menu tree depicted in FIGS. 13A and 13B is provided by way of example and can include many other crisp reheat instructions associated with other crispy exterior food items.

As further shown in the menu tree of FIGS. 13A and 13B, for each food type, and in some instances, the classification of the food type and the food item amount, the instructions include a "TURN TIME" or a time remaining at which the food item is to be flipped or turned over during the crisp reheat cycle. The times depicted in FIGS. 13A and 13B for the "TURN TIME" indicate the time remaining in the crisp reheat cycle at which the food item is to be flipped or turned over. Thus, for "CHICKEN" classified as "BREAST" for a food item amount of "1-2 PIECES", the turn time is three minutes (3 min). Accordingly, with three minutes (3 min) remaining in the eleven minute (11 min) cook time, controller 150 can activate display device 120 to display a user message at a predetermined time (e.g., at three minutes (3 min) remaining) during the crisp reheat cycle to prompt a user to turn the food item. In some instances, as will be explained further below, the user message displayed by display device 120 at the predetermined time corresponds with a check for doneness message indicating that the user should check the food item being crisp reheated. In some instances, the user message displayed by display device 120 at the predetermined time corresponds with a turn food message indicating that the food item being crisp reheated is to be turned, flipped, or otherwise moved during the crisp reheat cycle, e.g., manually by the user.

By way of example, as further depicted in the menu tree of FIGS. 13A and 13B, for each food type, and in some instances, the classification of the food type and the food item amount, the instructions include a "CHECK FOR DONENESS" or check for doneness time remaining at which the food item should be checked for doneness during the crisp reheat cycle. The times depicted in FIGS. 13A and 13B for the "CHECK FOR DONENESS" indicate the time remaining in the crisp reheat cycle at which the food item should be checked for doneness during the crisp reheat cycle. Thus, for "PIZZA" at food item amount of "1-2 SLICES", the check for doneness time is two minutes thirty seconds (2 min, 30 s). Accordingly, with two minutes thirty seconds (2 min, 30 s) remaining in the six minute thirty seconds (6 min, 30 s) cook time, controller 150 can activate display device 120 to display a user message at a predetermined time (e.g., at two minutes thirty seconds (2 min, 30 s) remaining) during the crisp reheat cycle to prompt a user to check the doneness of the food item. In this way, cooking appliance 100 accounts for potential deviations in the food ingredients, thickness of the food item, the thickness of the crispy exterior, etc.

With the data 170 accessed, controller 150 is further configured to retrieve a crisp reheat instruction from the plurality of crisp reheat instructions provided by the data 170 based at least in part on the input indicating the food type of the food item to be crisp reheated within the cooking cavity of the cooking appliance in the crisp reheat cycle. In some embodiments, the crisp reheat instruction retrieved from the plurality of crisp reheat instructions provided by the data 170 is based at least in part on the input indicating the food item amount of the food item to be crisp reheated in the crisp reheat cycle within the cooking cavity 128 of the cooking appliance 100. Further, in some embodiments, the crisp reheat instruction retrieved from the plurality of crisp reheat instructions provided by the data 170 is based at least in part on the food item classification of the food type. In yet other embodiments, the crisp reheat instruction retrieved from the plurality of crisp reheat instructions provided by the data 170 is based at least in part on whether the user has confirmed use of the suggested cooking utensil.

By way of example, with reference specifically to FIG. 13A, based on a food type selection of "POTATO" classified as "BAKED" having a food item amount of "½-2 PIECES", controller 150 accesses data 170 (e.g., stored in one or more memory device(s) of controller 150 and/or in one or more remote computing devices communicatively coupled with cooking appliance 100 via a network) that provides crisp reheat instructions for crisp reheating various food types. Once data 170 is accessed, controller 150 retrieves the relevant crisp reheat instruction, e.g., based at least in part on the input indicating the food type, the input indicating the food item classification of the food type, and/or the input indicating the food item amount of the food item. For instance, in this example, based on the selected user inputs, controller 150 retrieves the crisp reheat instructions for or associated with the food type "POTATO" classified as "BAKED" having a food item amount of "½-2 PIECES" (shown highlighted in FIG. 13A).

Once the crisp reheat instruction is retrieved from data 170, controller 150 sets the crisp reheat cycle to a cook time of six minutes (6 min). Controller 150 also sets the upper heater module 132 to a cycle time of thirty-two seconds per duty cycle (32 s/duty cycle; thus upper heater module 132 will be activated for the duration of the six minutes (6 min)), the lower heater module 134 to a cycle time of thirty-two seconds per duty cycle (32 s/duty cycle), the microwave module 160 to a cycle time of twenty seconds per duty cycle (20 s/duty cycle), and the convection module 140 to a cycle time of thirty-two seconds per duty cycle (32 s/duty cycle). When convection module 140 is activated, sheath heater 142 is activated to generate heat and convection fan 144 is activated to move air at least across sheath heater 142 and into cooking cavity 128. Further, based on the retrieved crisp reheat instruction, controller 150 sets: the upper heater module 132 to a power level of ten (10), the lower heater module 134 to a power level of ten (10), the microwave module 160 to a power level of six (6), and the convection module 140 to a power level of ten (10). In some embodiments, the power level of convection module 140 corresponds to a fan speed of convection fan 144. In yet other embodiments, the power level of convection module 140 can have a power level associated with the heat output of sheath heater 142 and a fan speed of convection fan 144. Further, based on the retrieved crisp reheat instruction, controller 150 sets the "CHECK FOR DONENESS" user message at one minute thirty seconds (1 min, 30 s) remaining in the six minute (6 min) cook time. Controller 150 also determines that the "TURN TIME" is not applicable for the parameters selected, and accordingly, no user message is set associated with the turn time of the food item.

Once controller 150 accesses the data 170, retrieves the crisp reheat instructions associated with the selected food type, classification, food item amount, etc., and sets the crisp reheat instructions for operating the cooking appliance 100 in the crisp reheat cycle, controller 150 activates at least one of the microwave module 160, the upper heater module 132, the lower heater module 134, and convection module 140 of cooking appliance 100 to crisp reheat the food item in the crisp reheat cycle in accordance with or based at least in part on the retrieved crisp reheat instruction. In some embodiments, at least two of microwave module 160, upper heater module 132, lower heater module 134, and convection module 140 of cooking appliance 100 are activated by controller 150 to crisp reheat the food item in the crisp reheat cycle. In yet other embodiments, at least three of microwave module 160, upper heater module 132, lower heater module 134, and convection module 140 of cooking appliance 100 are activated by controller 150 to crisp reheat the food item in the crisp reheat cycle. In some further embodiments, microwave module 160, upper heater module 132, lower heater module 134, and convection module 140 of cooking appliance 100 are all activated by controller 150 to crisp reheat the food item in the crisp reheat cycle. For instance, the crisp reheat instructions for the food type "QUICHE" (FIG. 13B) provide that each of the microwave module 160, upper heater module 132, lower heater module 134, and convection module 140 of cooking appliance 100 are all activated by controller 150 to crisp reheat the quiche food item in the crisp reheat cycle.

In some embodiments, microwave module 160, upper heater module 132, and convection module 140 are activated in accordance with the retrieved crisp reheat instructions. In this way, microwave module 160 can deliver microwave energy into cooking cavity 128 (e.g., to heat the interior of the food item), upper heater module 132 can deliver radiant and thermal energy to crisp or recrisp the exterior of the food item, and convection fan 144 of convection module 140 can move air about cooking cavity 128 to facilitate the speed and evenness of the crisp reheat cooking operation. However, other combinations of heating elements and convection fan 144 can be activated by controller 150.

In some embodiments, the retrieved crisp reheat instructions can provide for and controller 150 can activate different combinations of heating elements of the modules 132, 134, 160, 140 (e.g., at different cycle times and power levels). In this way, cooking appliance 100 can provide a certain crispiness effect to the food item being crisp reheated. For instance, in some example embodiments, one or both of radiant heaters 136 and 138 of upper heater module 132 and sheath heater 142 and convection fan 144 of convection module 140 are used to heat and crisp the exterior of the food items. In some embodiments, additionally or alternatively, ceramic heater 146 of lower heater module 134 can be used to heat the exterior of the food item. In yet other embodiments, additionally or alternatively, ceramic heater 146 and sheath heater 142 can be energized to heat the air in cooking cavity 128. In some embodiments, convection fan 144 can circulate air over the heating elements 136, 138, 142 to assure even cooking. In addition, microwave energy provided by microwave module 160 can be used to heat the inside of the food item, as noted above. Radiant heaters 136, 138 of upper heater module 132, the magnetron of microwave module 160, ceramic heater 146 of lower heater module 134, and sheath heater 142 and convection fan 144 of convection module 140 can be cycled throughout the crisp reheat cooking cycle to provide the desired cooking results.

Figure 12:
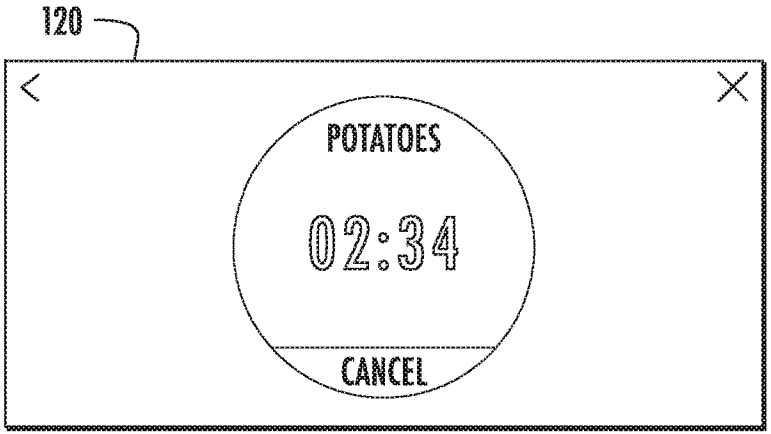

In some embodiments, controller 150 only starts or commences the crisp reheat cycle upon a user input. For instance, controller 150 can activate at least one of microwave module 160, upper heater module 132, lower heater module 134, and convection module 140 only after a user input is provided by a user. For instance, a user can select the "START" control button 124 (FIG. 1) to commence the crisp reheat cycle. A user can provide a user input to start or commence the crisp reheat cycle in other suitable manners as well. Once the crisp reheat cycle is commenced, a time remaining, a food item selected, and a "CANCEL" icon can be presented on display device 120, e.g., as shown in FIG. 12.

Figure 14:
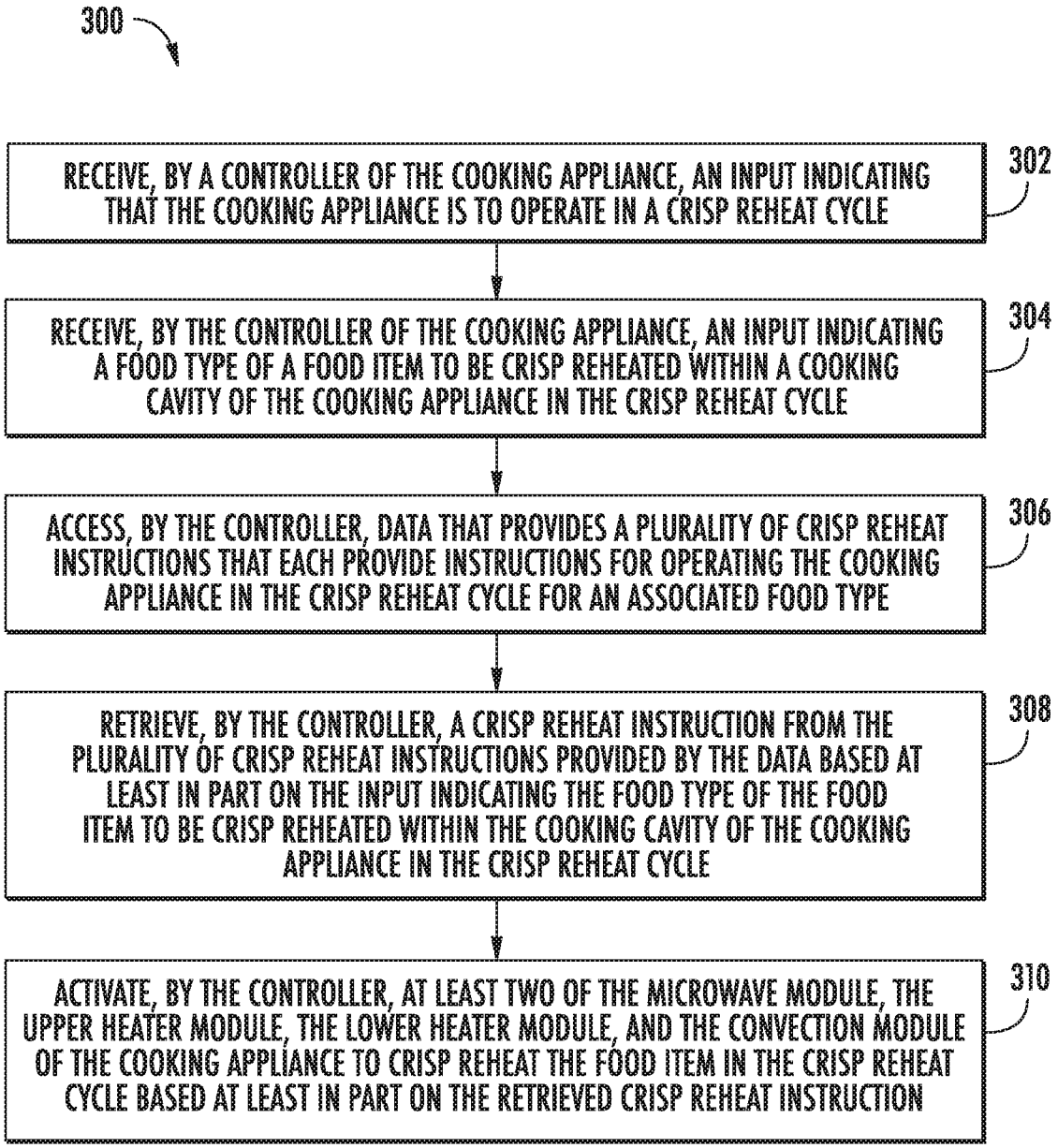
FIG. 14 provides a flow diagram of an exemplary method of operating a cooking appliance in a crisp reheat cycle according to an example embodiment of the present subject matter.

FIG. 14 provides a flow diagram of an example method (300) of operating a cooking appliance in a crisp reheat cycle according to an example embodiment of the present subject matter. For instance, cooking appliance 100 provided herein can be utilized to implement method (300). Accordingly, to provide context to method (300), the numerals used above to denote various features of cooking appliance 100 will be utilized below. The example method (300) described below provides one example manner in which a cooking appliance can be operated in a crisp reheat cycle, however, the description below is not intended to be limiting.

At (302), the method (300) includes receiving, by a controller of the cooking appliance, an input indicating that the cooking appliance is to operate in a crisp reheat cycle. For instance, the cooking appliance can be the cooking appliance 100 provided herein and the controller can be controller 150. Cooking appliance 100 can be operated in the crisp reheat cycle to crisp reheat a food item. For instance, the food item can be a food item having a crispy exterior that has been previously heated or cooked (e.g., above room temperature) and then cooled (e.g., to or below room temperature). As one example, the food item to be crisp reheated can be previously heated or cooked to a temperature at or above one hundred degrees Fahrenheit (100° F.) ≈38° C.) and then cooled to a temperature at or below forty degrees Fahrenheit (40° F.) ≈4° C.).

In some implementations, a user can commence a crisp reheat cycle by providing a user input to select the "PRECISION COOKING" option on the home page of display device 120 as shown in FIG. 6. Alternatively, a user can provide a user input to select the dedicated "PRECISION COOKING" control button 124 depicted in FIG. 1. In yet other implementations, a user can commence a crisp reheat cycle via user input in other suitable ways. At (302), controller 150 can receive an input indicating that cooking appliance 100 is to operate in a crisp reheat cycle.

At (304), the method (300) includes receiving, by the controller of the cooking appliance, an input indicating a food type of a food item to be crisp reheated within a cooking cavity of the cooking appliance in the crisp reheat cycle. For instance, a user can select a food type from among a plurality of food types. For example, a user can provide a user input to select a food type of the food item to be crisp reheated in the crisp reheat cycle as shown in FIG. 8, e.g., by providing a touch input to display device 120. In yet other embodiments, a user can use dial 122 (FIG. 1) in combination with display device 120 to select the food type. For example, once the crisp reheat mode is selected, various food items can be displayed by display device 120. Dial 122 can be used to scroll through the displayed food items and a user can select a food type by pressing dial 122 inward or by selecting some other confirmation control button 124. At (304), controller 150 can receive an input indicating a food type of a food item to be crisp reheated in the within cooking cavity 128 of cooking appliance 100 in the crisp reheat cycle.

In addition, in some implementations, the method (300) can include receiving, by the controller, an input indicating a food item amount of the food item to be crisp reheated in the crisp reheat cycle within the cooking cavity of the cooking appliance. The method (300) can also include receiving, by the controller, an input indicating a food item classification of the food type. As will be explained further below, such inputs can be utilized in retrieving the correct or most relevant crisp reheat instruction at (308).

At (306), the method (300) includes accessing, by the controller, data that provides a plurality of crisp reheat instructions that each provide instructions for operating the cooking appliance in the crisp reheat cycle for an associated food type. For instance, the data can be stored in one or memory device(s) of controller 150. Additionally or alternatively, the data can be stored in one or more remote computing devices communicatively coupled with controller 150 of cooking appliance 100. The data 170 can include a menu tree, such as the menu tree shown in FIGS. 13A and 13B. In the menu tree depicted in FIGS. 13A and 13B, the plurality of crisp reheat instructions are organized by row. Particularly, the menu tree of FIGS. 13A and 13B includes crisp reheat instructions for the following food types: "ROLLS/BREAD", "CASSEROLE", "CHICKEN", "PIZZA", "POTATOES", "FRIED FINGER FOOD", "PANCAKE/WAFFLE", "PIE", and "QUICHE".

Each food type can include different classifications and food item amounts, and thus, multiple crisp reheat instructions can be associated with a particular food type. For instance, as shown in FIG. 13A, the food type "CHICKEN" has eight (8) associated crisp reheat instructions. Particularly, two (2) crisp reheat instructions are associated with the "BREAST" classification of "CHICKEN" with one instruction being associated with "1-2 PIECES" and the other instruction being associated with "3-4 PIECES", two (2) crisp reheat instructions are associated with the "NUGGETS" classification of "CHICKEN" with one instruction being associated with "1-2 CUPS" and the other instruction being associated with "3-4 CUPS", two (2) crisp reheat instructions are associated with the "TENDERS" classification of "CHICKEN" with one instruction being associated with "1-2 PIECES" and the other instruction being associated with "3-4 PIECES", and two (2) crisp reheat instructions are associated with the "WINGS" classification of "CHICKEN" with one instruction being associated with "1-2 PIECES" and the other instruction being associated with "3-4 PIECES". The "PIE", "POTATES" food types likewise have multiple associated crisp reheat instructions. Each of the plurality of crisp reheat instruction can include a cook time, a cycle time for the microwave module, the upper heater module, and the lower heater module, and a power level for the microwave module, the upper heater module, and the lower heater module.

At (308), the method (300) includes retrieving, by the controller, a crisp reheat instruction from the plurality of crisp reheat instructions provided by the data based at least in part on the input indicating the food type of the food item to be crisp reheated within the cooking cavity of the cooking appliance in the crisp reheat cycle. For instance, the data accessed at (306), the controller 150 can retrieve a crisp reheat instruction that is associated with the food type selected by the user (which is received by controller 150 via an input). The retrieved crisp reheat instruction can include a cook time, a cycle time for the microwave module, the upper heater module, the lower heater module, and the convection module as well as a power level for the microwave module, the upper heater module, the lower heater module, and the convection module. Once the crisp reheat instruction is retrieved and set, controller 150 can operate cooking appliance 100 in the crisp reheat cycle based at least in part on the retrieved crisp reheat instruction as will be discussed further at (310).

By way of example, with reference to FIG. 13B, if a user has selected "PIE" as the food type, classified the food type as "SWEET" having a food item amount of "1-2 SLICES", controller 150 accesses data 170 and retrieves the crisp reheat instruction, e.g., based at least in part on the input indicating the food type. In some implementations, the crisp reheat instruction retrieved from the data 170 (e.g., a menu tree) is based at least in part on the input indicating the food item classification of the food type, and/or the input indicating the food item amount of the food item. For instance, in this example, controller 150 retrieves the crisp reheat instructions for the food type "PIE" classified as "SWEET" having a food item amount of "1-2 SLICES". Accordingly, controller 150 can set the crisp reheat cycle to: a cook time of five minutes thirty seconds (5 min, 30 s). The controller can also set the upper heater module 132 to a cycle time of thirty-two seconds per duty cycle, the lower heater module 134 to a cycle time of thirty-two seconds per duty cycle (32 s/duty cycle, the microwave module 160 to a cycle time of five seconds per duty cycle (5 s/duty cycle), the convection fan 144 of convection module 140 to a cycle time of thirty-two seconds per duty cycle (32 s/duty cycle). The controller can also set the upper heater module 132 to a power level of ten (10), the lower heater module 134 to a power level of ten (10), the microwave module 160 to a power level of one (1), and the convection fan 144 of convection module 140 to a power level of ten (10). Further, controller 150 sets the "CHECK FOR DONENESS" user message at one minute thirty seconds (1 min, 30 s) remaining in the five minute thirty second (5 min, 30 s) cook time. Controller 150 also determines that the "TURN TIME" is not applicable for the parameters selected, and accordingly, no user message is set associated with the turn time of the food item.

At (310), the method (300) includes activating, by the controller, at least two of the microwave module, the upper heater module, the lower heater module, and the convection module of the cooking appliance to crisp reheat the food item in the crisp reheat cycle based at least in part on the retrieved crisp reheat instruction. For instance, in some implementations, during activating at (310), the controller 150 activates microwave module 160 and upper heater module 132. When activated by the controller 150, the microwave module 160 is operable to deliver microwave energy into the cooking cavity 128 (e.g., to heat the interior of the food item). Further, in some implementations, the upper heater module has ceramic heater 136 and halogen lamp 138. In some implementations, halogen lamp 138 is activated (e.g., to crisp the exterior of the food item) along with microwave module 160. In this way, the interior of the food item can be heated with microwave energy and the exterior can be crisped with radiant and thermal energy from halogen lamp 138. In some implementations, additionally or alternatively, ceramic heater 136 of upper heater module 132 and/or sheath heater 142 of convection module 140 can be activated along with microwave module 160.

Further, in some implementations, during activating at least two of the microwave module, the upper heater module, the lower heater module, and the convection module of the cooking appliance to crisp reheat the food item in the crisp reheat cycle, the method (300) includes activating, by the controller, each of the microwave module, the upper heater module, the lower heater module, and the convection module of the cooking appliance based at least in part on the retrieved crisp reheat instruction. In yet other implementations, during activating at least two of the microwave module, the upper heater module, the lower heater module, and the convection module of the cooking appliance to crisp reheat the food item in the crisp reheat cycle, the method (300) includes activating, by the controller, at least three of the microwave module, the upper heater module, the lower heater module, and the convection module of the cooking appliance based at least in part on the retrieved crisp reheat instruction.

In implementations in which convection module 140 is activated, the method (300) can include activating, by the controller, the convection fan to move air within the cooking cavity. In some implementations, the convection fan moves air over or across one or more heating elements and into the cooking cavity. For instance, in some implementations, when activated by controller 150, convection fan 144 is operable to move air over or across sheath heater 142 of convection module 140 and into cooking cavity 128. In this way, air can be circulated through and within cooking cavity 128 to provide for a faster and more even crisp reheating operation. In some implementations, additionally, when activated by controller 150, convection fan 144 is operable to move air over or across halogen lamp 138 and/or ceramic heater 136 and into the cooking cavity 128. In yet other implementations, convection fan 144 can move air over or across ceramic heater 146 of lower heater module 134. In yet other implementations, the method (300) can include activating or causing, by the controller, a display device communicatively coupled with the controller to display a user message at a predetermined time during the crisp reheat cycle based at least in part on the retrieved crisp reheat instruction. For instance, in some implementations, the crisp reheat instructions can include instructions for displaying a "TURN TIME" to a user, e.g., so that a user knows when to turn over the food item in the cooking cavity 128. In yet other implementations, the crisp reheat instructions can include instructions for displaying a "CHECK FOR DONE- NESS" to a user, e.g., so that a user knows when to check the food item in the cooking cavity 128 for doneness.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A cooking appliance, comprising:

a casing defining a cooking cavity;

a microwave module for delivering microwave energy into the cooking cavity;

an upper heater module having one or more heating elements;

a lower heater module having one or more heating elements;

a convection module having one or more heating elements and a convection fan operable to move air within the cooking cavity; and a controller communicatively coupled with the microwave module, the upper heater module, the lower heater module, and the convection module for selective control thereof, the controller configured to:

receive an input indicating that the cooking appliance is to operate in a crisp reheat cycle;

receive an input indicating a food type of a food item to be crisp heated within the cooking cavity of the cooking appliance in the crisp reheat cycle;

receive an input indicating a food item amount of the food item to be crisp reheated in the crisp reheat cycle within the cooking cavity of the cooking appliance;

access data that provides a plurality of crisp reheat instructions that each provide instructions for operating the cooking appliance in the crisp reheat cycle for an associated food type;

retrieve a crisp reheat instruction from the plurality of crisp reheat instructions provided by the data based at least in part on the input indicating the food type and the input indicating the food amount of the food item to be crisp reheated within the cooking cavity of the cooking appliance in the crisp reheat cycle; and activate at least one of the microwave module, the upper heater module, the lower heater module, and the convection module of the cooking appliance to crisp reheat the food item in the crisp reheat cycle based at least in part on the retrieved crisp reheat instruction, and wherein the controller is further configured to:

cause the display device to display a suggested cooking utensil for cooking the food item in the crisp reheat cycle based at least in part on the food type of the food item, and wherein the crisp reheat instruction retrieved from the plurality of crisp reheat instructions is based at least in part on whether the user has confirmed use of the suggested cooking utensil.

2. The cooking appliance of claim 1, wherein at least two of the microwave module, the upper heater module, the lower heater module, and the convection module of the cooking appliance are activated by the controller to crisp reheat the food item in the crisp reheat cycle based at least in part on the retrieved crisp reheat instruction.

3. The cooking appliance of claim 1, wherein the retrieved crisp reheat instruction comprises a cook time, a cycle time, and a power level for the microwave module, the upper heater module, the lower heater module, and the convection module.

4. The cooking appliance of claim 1, further comprising:

a display device communicatively coupled with the controller, wherein the controller is further configured to:

cause the display device to display a user message at a predetermined time during the crisp reheat cycle based at least in part on the retrieved crisp reheat instruction.

5. The cooking appliance of claim 4, wherein the user message displayed by the display device at the predetermined time corresponds with at least one of a check for doneness message and a turn food message.

6. The cooking appliance of claim 1, wherein the one or more heating elements of the convention module include a sheath heater, and wherein, when the convection module is activated during the crisp reheat cycle by the controller, the convection fan moves air within the cooking cavity.

7. The cooking appliance of claim 1, wherein the one or more heating elements of the upper heater module include a halogen lamp configured to deliver radiant and thermal energy into the cooking cavity during the crisp reheat cycle.

8. The cooking appliance of claim 1, wherein the food item to be crisp reheated in the crisp reheat cycle within the cooking cavity of the cooking appliance is previously heated and then cooled in a chilled chamber of a refrigerator appliance.

9. The cooking appliance of claim 1, wherein the cooking appliance is at least one of a 240V cooking appliance and a 120V cooking appliance.

10. The cooking appliance of claim 1, wherein the crisp reheat instruction retrieved is one of multiple crisp reheat instructions associated with the food type, the multiple crisp reheat instructions associated with the food type having different power levels for at least one of the microwave module, the upper heater module, the lower heater module, and the convection module.

11. A method for operating a cooking appliance in a crisp reheat cycle, the method comprising:

receiving, by a controller of the cooking appliance, an input indicating that the cooking appliance is to operate in the crisp reheat cycle;

receiving, by the controller of the cooking appliance, an input indicating a food type of a food item to be crisp reheated within a cooking cavity of the cooking appliance in the crisp reheat cycle;

accessing, by the controller, data that provides a plurality of crisp reheat instructions that each provide instructions for operating the cooking appliance in the crisp reheat cycle for an associated food type;

causing, by the controller, a display device communicatively coupled with the controller to display a suggested cooking utensil for cooking the food item in the crisp reheat cycle based at least in part on the food type of the food item;

retrieving, by the controller, a crisp reheat instruction from the plurality of crisp reheat instructions provided by the data based at least in part on the input indicating the food type of the food item to be crisp reheated within the cooking cavity of the cooking appliance in the crisp reheat cycle, and wherein the crisp reheat instruction retrieved from the plurality of crisp reheat instructions is based at least in part on whether use of the suggested cooking utensil has been confirmed; and activating, by the controller, at least one of a microwave module, an upper heater module, a lower heater module, and a convection module of the cooking appliance to crisp reheat the food item in the crisp reheat cycle based at least in part on the retrieved crisp reheat instruction.

12. The method of claim 11, wherein the retrieved crisp reheat instruction comprises a cook time, a cycle time, and a power level for the microwave module, the upper heater module, the lower heater module, and the convection module.

13. The method of claim 11, wherein during activating, by the controller, at least two of the microwave module, the upper heater module, the lower heater module, and the convection module of the cooking appliance to crisp reheat the food item in the crisp reheat cycle based at least in part on the retrieved crisp reheat instruction, the microwave module and the convection module are activated.

14. The method of claim 11, wherein the upper heater module has at least one of a halogen lamp and a ceramic heater, and wherein, when the upper heater module is activated by the controller, the upper heater module is operable to deliver radiant and thermal energy into the cooking cavity based at least in part on the retrieved crisp reheat instruction.

15. The method of claim 11, wherein the convection module has a convection fan and a sheath heater, and wherein the method further comprises:

activating, by the controller, the convection fan to move air within the cooking cavity.

16. The method of claim 11, further comprising:

receiving, by the controller, an input indicating a food item amount of the food item to be crisp reheated in the crisp reheat cycle within the cooking cavity of the cooking appliance, and wherein the crisp reheat instruction retrieved by the controller is based at least in part on the food item amount of the food item to be crisp reheated in the crisp reheat cycle within the cooking cavity of the cooking appliance.

17. The method of claim 11, further comprising:

receiving, by the controller, an input indicating a food item classification of the food type, and wherein the crisp reheat instruction retrieved by the controller is based at least in part on the food item classification of the food type.

18. The method of claim 11, further comprising:

causing, by the controller, the display device to display a user message at a predetermined time during the crisp reheat cycle based at least in part on the retrieved crisp reheat instruction.

* * * * *